US009575458B2

(12) United States Patent
Liu et al.

(10) Patent No.: US 9,575,458 B2
(45) Date of Patent: Feb. 21, 2017

(54) METHOD FOR LUBRICATING IMAGING MEMBER BY APPLYING LUBRICANT-CONTAINING CAPSULES VIA A NON-CONTACT APPLICATOR

(71) Applicant: Xerox Corporation, Norwalk, CT (US)

(72) Inventors: Yu Liu, Mississauga (CA); Johann Junginger, Toronto (CA); Sarah Vella, Milton (CA); Cuong Vong, Hamilton (CA); Naveen Chopra, Oakville (CA); Nan-Xing Hu, Oakville (CA)

(73) Assignee: XEROX CORPORATION, Norwalk, CT (US)

( * ) Notice: Subject to any disclaimer, the term of this patent is extended or adjusted under 35 U.S.C. 154(b) by 79 days.

(21) Appl. No.: 14/075,547

(22) Filed: Nov. 8, 2013

(65) Prior Publication Data

US 2015/0132037 A1 May 14, 2015

(51) Int. Cl.
*G03G 21/00* (2006.01)

(52) U.S. Cl.
CPC ..... *G03G 21/0094* (2013.01)

(58) Field of Classification Search
CPC ..... G03G 21/0094; G03G 2221/0005
See application file for complete search history.

(56) References Cited

U.S. PATENT DOCUMENTS 5,262,830 A * 11/1993 Inaishi ..... 399/49
5,963,760 A * 10/1999 Takeda et al. ..... 399/159
7,160,663 B2 1/2007 Komoto et al.
7,796,934 B2 9/2010 Teshigawara
7,986,910 B2 7/2011 Kabata et al.
8,133,646 B2 3/2012 Anno et al.
2007/0258743 A1* 11/2007 Shakuto et al. ..... 399/346
2008/0069614 A1* 3/2008 Shintani ..... G03G 21/0035 399/346
2009/0220876 A1* 9/2009 De Jong et al. ..... 430/58.8
2009/0226828 A1* 9/2009 De Jong et al. ..... 430/58.8
2012/0201585 A1* 8/2012 Hu et al. ..... 399/346
2012/0251937 A1 10/2012 Fujita et al.
2013/0017006 A1* 1/2013 Suda ..... 399/346
2013/0142529 A1* 6/2013 Morimoto ..... 399/53

(Continued)

FOREIGN PATENT DOCUMENTS

JP 2002-062737 * 2/2002 ..... G03G 15/09
JP 2007-328098 * 12/2007 ..... G03G 21/00

(Continued)

OTHER PUBLICATIONS

Synonyms for "polyoxymethylene urea", obtained from WayBackMachine (https://web.archive.org/web/20110727152508/http://www.chemindustry.com/chemicals/0863651.html), Jul. 27, 2011.*

(Continued)

*Primary Examiner* — Erika J Villaluna
(74) *Attorney, Agent, or Firm* — Fay Sharpe LLP

(57) ABSTRACT

Methods for lubricating an imaging member include applying lubricant-containing capsules to the surface of the imaging member via a non-contact applicator. The capsules are applied upstream of a cleaning blade after image transfer to another substrate, such that the cleaning blade ruptures the capsules, thereby releasing the lubricant contained therein.

20 Claims, 5 Drawing Sheets

(56) References Cited

U.S. PATENT DOCUMENTS

2013/0156474 A1 6/2013 McGuire et al.

FOREIGN PATENT DOCUMENTS

| | | | | |
|---|---|---|---|---|
| JP | 2008-310194 | * | 12/2008 | ..... G03G 21/10 |
| JP | 2009294248 A | * | 12/2009 | |
| JP | 2012181317 A | * | 9/2012 | |

OTHER PUBLICATIONS

Dow Corning, Powerpoint presentation, "New Delivery Systems from Dow Corning", obtained from (https://www.dowcorning.com/content/publishedlit/personal_deliver_pres.ppt.), Dec. 2005.*

Dow Corning, Google cached HTML version of the Powerpoint presentation, "New Delivery Systems from Dow Corning", obtained from (https://www.dowcorning.com/content/publishedlit/personal_deliver_pres.ppt.), Dec. 2005.*

Akazawa et al. (JP 2012-181317 A), Sep. 2012, JPO Computer Translation.*

U.S. Appl. No. 13/853,976, filed Mar. 29, 2013; Klenkler, et al.; Not yet published.

U.S. Appl. No. 13/910,935, filed Jun. 5, 2013; Liu, et al.; Not yet published.

* cited by examiner

METHOD FOR LUBRICATING IMAGING MEMBER BY APPLYING LUBRICANT-CONTAINING CAPSULES VIA A NON-CONTACT APPLICATOR

BACKGROUND

The present disclosure relates to methods for lubricating imaging members (e.g., photoreceptors).

A conventional printing apparatus includes an electrophotographic imaging member, a development component, a transfer component, and a fusing member. The electrophotographic imaging member has a charge-retentive surface to receive an electrostatic latent image thereon. The electrophotographic imaging member generally comprises a substrate, an electrically conductive layer when the substrate is not electrically conductive, a charge generating layer, and a charge transport layer. A bias charge roller applies a uniform charge to the charge-retentive surface. The surface is then exposed to a pattern of activating electromagnetic radiation, for example light, which selectively dissipates the charge to create an electrostatic latent image. After the electrostatic latent image is generated, the development component applies a developer material, e.g. toner, to the charge-retentive surface to develop the electrostatic latent image and form a developed image. The transfer component transfers the developed image from the charge-retentive surface to another substrate, such as an intermediate transfer member or a copy substrate such as paper. The fusing member fuses the developed image to the copy substrate.

A long service lifetime is desirable for the imaging member. Some obstacles can include less reliable cleaning blade efficiency, degraded image quality in the A-zone (28° C., 85% relative humidity), and higher energy consumption to drive the imaging member drum motor. It would be desirable to develop contactless and actively controlled systems and methods that can increase the lifetime of an imaging member.

BRIEF DESCRIPTION

The present disclosure relates to systems and methods for lubricating imaging members. The methods include applying or transferring lubricant-containing capsules to a surface of the imaging member, and then breaking the capsules to release the lubricant and lubricate the imaging member. The capsules are transferred using non-contact means.

Disclosed in embodiments is a method for lubricating an imaging member. The method includes transferring lubricant-containing capsules onto a surface of the imaging member via a non-contact applicator. The capsules are then broken to release the lubricant and lubricate the imaging member.

In some embodiments, the imaging member is contained in a printing apparatus that further comprises a cleaning blade for cleaning the imaging member and a development member for forming a developed image on the imaging member. The capsules may be added to the surface at a location downstream of the development member and upstream of the cleaning blade. Sometimes, a transfer component is also located downstream of the development member and upstream of the cleaning blade, and the capsules are added downstream of the transfer component and upstream of the cleaning blade.

The capsules may have a core-shell construction that includes a lubricant core within an encapsulant shell. The lubricant may be a paraffin oil.

In some embodiments, the non-contact applicator includes a capsule container for storing the lubricant-containing capsules and a transfer roller for transferring the lubricant-containing capsules to the surface of the imaging member. The method may further include generating an electrical field between the transfer roller and the surface of the imaging member. The transfer roller can be a brush roller or a foam roller.

The encapsulant used for making the capsules may be methoxy methyl methylol melamine (MMM) or polyoxymethylene urea (PMU).

The capsules may have an average particle size (diameter) of from about 3 μm to about 16 μm, including from about 5 to about 14 μm.

The distance between the surface of the imaging member and the non-contact applicator may be from about 0.1 cm to about 10 cm. In more specific embodiments, this distance is about 1.0 cm.

Disclosed in other embodiments is a method for increasing the lifetime of an imaging member of a printing apparatus. The method includes monitoring the friction level between a surface of the imaging member and a second component of the printing apparatus. Lubricant-containing capsules are transferred to a surface of the imaging member via a non-contact applicator when the friction level exceeds a predetermined threshold value. The capsules are then broken to lubricate the imaging member.

The friction level may be monitored by measuring changes in torque of the imaging member and/or the second component.

Disclosed in further embodiments is a printing apparatus. The printing apparatus includes an imaging member; a development member for forming a developed image on the imaging member; a cleaning blade; and a non-contact applicator for applying lubricant-containing capsules to a surface of the imaging member at a location downstream of the development member and upstream of the cleaning blade. The non-contact applicator includes a capsule container for storing the lubricant-containing capsules; a transfer roller for removing the lubricant-containing capsules from the capsule container; and a power supply for generating an electric field between the transfer member and the surface. The non-contact applicator may further include a metering member (e.g., a blade or roller) for controlling the amount of capsules that are attached to the surface of the transfer member.

The apparatus may further comprise (i) a driving motor for the imaging member or the development member, and (ii) a transmission gear system running from the driving motor to the transfer roller of the non-contact applicator.

These and other non-limiting characteristics of the disclosure are more particularly discussed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
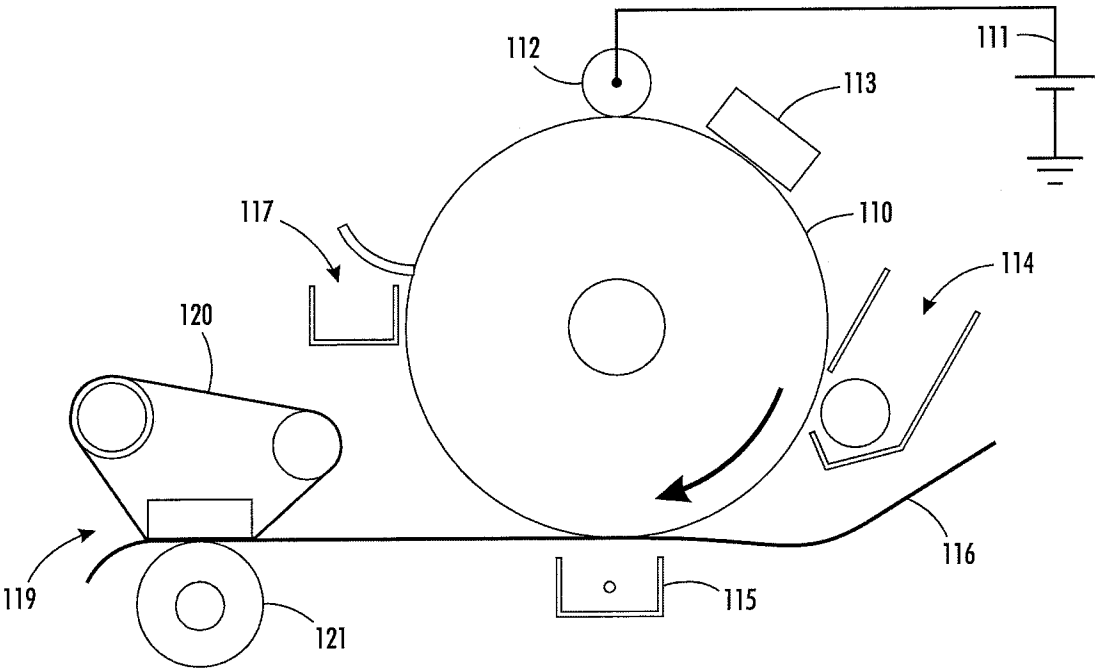
FIG. 1 (PRIOR ART)
FIG. 1 illustrates a prior art printing apparatus.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

A value modified by a term or terms, such as "about" and "substantially," may not be limited to the precise value specified. The modifier "about" should also be considered as disclosing the range defined by the absolute values of the two endpoints. For example, the expression "from about 2 to about 4" also discloses the range "from 2 to 4."

As used herein, the terms "upstream" and "downstream" are relative to the order in which steps are performed and or components are used in the printing processes and apparatuses of the present disclosure. For example, the cleaning station is downstream of the ink transfer station. It should be noted that in certain embodiments (e.g. when the imaging member is a drum), a first step/component can be described as being both upstream of and downstream of a second step/component as the printing process is repeated.

Initially, FIG. 1 illustrates the printing process in a conventional printing apparatus (e.g. a printer), and is useful for discussing the changes and differences described in the present disclosure. The charge-retentive surface of the imaging member 110 is charged by a bias charge roller 112 to which a voltage has been supplied from power supply 111. The imaging member is then imagewise exposed to light from an optical system or an image input apparatus 113, such as a laser or light emitting diode, to form an electrostatic latent image thereon. Generally, the electrostatic latent image is developed by bringing a developer mixture from developer station 114 into contact therewith. Development can be effected by use of a magnetic brush, powder cloud, or other known development process. A dry developer mixture usually comprises carrier granules having toner particles adhering triboelectrically thereto. Toner particles are attracted from the carrier granules to the latent image forming a toner powder image thereon. Alternatively, a liquid developer material may be employed, which includes a liquid carrier having toner particles dispersed therein. The liquid developer material is advanced into contact with the electrostatic latent image and the toner particles are deposited thereon. After the toner particles have been deposited on the photoconductive surface, they are transferred to a copy substrate 116 by transfer component 115, which can be pressure transfer or electrostatic transfer. Alternatively, the developed image can be transferred to an intermediate transfer member, or bias transfer member, and subsequently transferred to a copy substrate. Examples of copy substrates include paper, transparency material such as polyester, polycarbonate, or the like, cloth, wood, or any other desired material upon which the finished image will be situated. After the transfer of the developed image is completed, the copy substrate 116 advances to fusing member 119, depicted as fuser belt 120 and pressure roll 121, wherein the developed image is fused to copy substrate 116 by passing the copy substrate between the fuser belt and pressure roll, thereby forming a permanent image. Alternatively, transfer and fusing can be effected by a transfix application. The imaging member 110 then advances to cleaning station 117, wherein any remaining toner on the surface is cleaned therefrom by use of a blade, brush, or other cleaning apparatus.

Friction between the imaging member surface and other components such as the bias charge roller causes operational problems and reduces the lifetime of the imaging member. Some efforts to address these problems include the external application of functional materials onto the imaging member surface. A "functional material" is a material that provides maintenance of desired imaging member function, such as a lubricant which reduces friction. Solid-phase powder application systems and liquid surface control systems have been used with imaging members. The solid-phase systems can better control the amount of lubricant applied, have easier ON/OFF control, and provide more quantitative calibration of the system. Liquid systems have advantages such as improved coating uniformity, a reduction in the amount of functional material required, and less impact on wearing of the imaging member and bias charge roller. In both types of systems, a contact applicator is used, wherein a physical component directly touches the surface of the imaging member in order to transfer the lubricant. However, the contact between the applicator and the imaging member can result in friction, thereby degrading the performance of the applicator and image quality.

In the present disclosure, systems and methods are disclosed for lubricating the imaging member surface by non-contact means, i.e. wherein the applicator is physically located a distance away from the imaging member surface, and lubricant is transferred across the distance. For example, depending on the orientation of the various components in the printing apparatus, an electrical field can be used to transport the lubricant.

Figure 2:
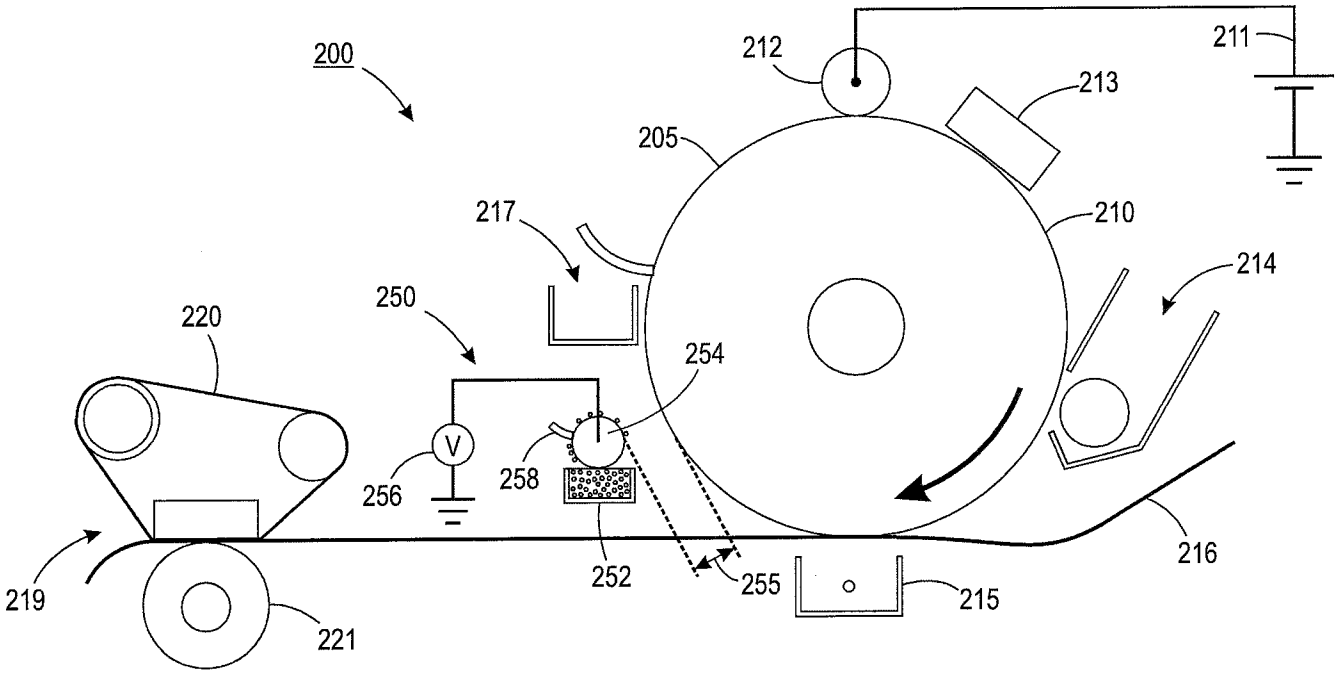
FIG. 2 illustrates an exemplary embodiment of a printing apparatus of the present disclosure.

FIG. 2 illustrates an exemplary printing apparatus 200 of the present disclosure. The apparatus 200 includes an imaging member 210 having an outermost surface 205. The bias charge roller 212 is a contact-type charging device, powered by a power supply 211, for charging the surface 205 of the imaging member. The bias charge roller 212 charges the surface 205 to a uniform, predetermined potential. The uniform charging erases any residual image left on the surface 205 to ensure that the imaging member is ready for subsequent image-forming. The imaging member surface 205 is then exposed to a pattern of activating electromagnetic radiation (e.g., light) by image input apparatus 213 located downstream of the bias charge roller. The radiation selectively dissipates the charge on the exposed areas, thereby leaving behind an electrostatic latent image.

The apparatus 200 further includes a development member 214 located downstream of the bias charge roller 212 and the image input apparatus 213. The development member 214 selectively provides a development material (e.g., toner) selectively to form a developed image. The deposited development material may include particles of the same or opposite polarity as the latent image. The resulting visible image may then be transferred from the imaging member directly or indirectly (e.g., via additional intermediate rollers) to a print substrate 216 (e.g., paper or a transparency) at transfer component 215. Transfer component 215 is downstream of the development member 214, and upstream of the cleaning blade 217. The developed image is fused to copy substrate 216 at fusing station 219, again depicted here as fuser belt 220 and pressure roll 221. The fusing station is downstream of the transfer component 215, but is on a different path from the cleaning blade 217, i.e. both the fusing station and the cleaning blade are downstream of the transfer component, but one is not upstream of the other.

To reduce friction between the various components with the imaging member surface, the apparatus 200 of the present disclosure further includes a non-contact applicator 250 that is used to transfer lubricant-containing capsules to the imaging member surface 205. In use, the lubricant-containing capsules rupture upon contact with the cleaning blade 217, releasing lubricant onto the imaging member surface. The released lubricant spreads over the imaging member surface 205, and the cleaning blade can also serve a dual purpose of helping to uniformly spread the lubricant over the surface. The non-contact applicator 250 transfers or applies the lubricant-containing capsules onto the imaging member surface 205 downstream of the development member 214 and upstream of the cleaning blade 217. In more specific embodiments, the lubricant-containing capsules are transferred onto the imaging member surface 205 downstream of the transfer component 215 and upstream of the cleaning blade 217.

The non-contact applicator 250 includes a capsule container 252 and a transfer roller 254 used to transfer capsules out of the container for application onto the imaging member surface, and is powered by a power source, illustrated here with reference numeral 256. The capsule container 252 stores the lubricant-containing capsules. The transfer roller 254 can be a brush roller or a foam roller. A brush roller includes a central rod having bristles extending radially therefrom, while a foam roller includes a central rod having its outer surface made of a foam. The bristles or the foam of the roller are used to transport the lubricant-containing capsules out of the capsule container to be transferred to the imaging member surface without any the transfer roller physically contacting the imaging member surface.

The power source for the non-contact applicator can be the same power source used for the other components of the printing apparatus. The transfer roller 254 may be actively rotated through an independent motor or a transmission gear system in connection with a driving motor associated with one or more other components (e.g., the imaging member 210 and/or development member 214). A metering blade 258 is illustrated here for controlling the number of capsules that attach to the surface of the transfer roller 254.

In operation, an electric field is generated between the transfer roller 254 and the imaging member surface 205. This electrical field causes the lubricant-containing capsules to move from the transfer roller 254 to the imaging member surface 205 without physical contact between the two components. The distance between the transfer roller 254 and the imaging member surface 205 is indicated with reference numeral 255, and can be from about 0.1 centimeters (cm) to about 10 cm. Ideally, this distance is about 1.0 cm.

The power source 256 is used to establish an electrical field (between the transfer roller and the imaging member surface) through a controllable ON/OFF switch. The power source may be the same power source used to charge the bias charge roller or may be a separate power source. The bias charge roller supply voltage may be a DC voltage of up to about 1 kV. A scorotron DC voltage may be up to about 9 kV. The electric field causes capsules on the transfer roller to move towards the imaging member.

The lubricant-containing capsules have a core-shell structure. Put another way, a shell surrounds and encapsulates a core. The shell is made from an encapsulant material. The core contains the lubricant. When the encapsulant is pierced by the cleaning blade, the lubricant is released onto the imaging member.

The lubricant may be a mineral oil. Mineral oil is derived from a non-vegetable source, typically as a byproduct of petroleum distillation. Mineral oil is a colorless, odorless, light mixture of alkanes having from about 15 to about 40 carbon atoms. The three main types of mineral oil are paraffin oils, naphthenic oils, and aromatic oils. Paraffin oils are based on n-alkanes. Naphthenic oils are based on cycloalkanes. Aromatic oils are based on aromatic hydrocarbons. The mineral oil may comprise one or more of these specific types. In specific embodiments, the lubricant is a paraffin oil.

The thickness of the polymeric shell may be in a range between about 10 nanometers (nm) to about 1 micrometer (μm), between about 50 nm to about 0.5 μm, or between about 100 nm to about 500 nm. Suitable examples of polymeric shell include, but are not limited to, melamine, urethane, and mixtures thereof. In particular embodiments, the encapsulant used to form the shell of the capsules may be gelatin, methoxy methyl methylol melamine (MMM), polyoxymethylene urea (PMU), or mixtures thereof.

The resulting capsules, having a core and a shell, may have an average particle size of from about 3 μm to about 16 μm, including from about 5 μm to about 14 μm. The particle size is reported as the diameter of a sphere having the same average volume. The capsules can be made using methods known in the art. It should be recognized that the capsules are not necessarily perfectly spherical, and may be ellipsoidally shaped.

Preferably the capsules are prepared by a precipitation method whereby polymers in solution are precipitated around a hydrophobic core material, resulting in a clear, non-pigmented shell surrounding a single droplet or particle of core material. Such capsules are available from Lipo Technologies Inc.

The application of the capsules onto the imaging member surface may be controlled to minimize material costs, as constant lubrication is not required. In some embodiments, the friction between the imaging member surface and a second component (e.g., the bias charge roller) is monitored. When the friction level exceeds a predetermined threshold value, the non-contact applicator is turned on, and lubricant-containing capsules are applied to the imaging member surface. The capsules are broken upon contact with the cleaning blade, or put another way at the contact position between the cleaning blade and the imaging member. It is noted that after rupturing the capsules, the polymeric shells can be disposed of using the same waste container that the excess toner is currently disposed in.

The present disclosure will be further illustrated in the following non-limiting example, it being understood that the example is intended to be illustrative only and the disclosure is not intended to be limited to the materials, conditions, process parameters, and the like recited herein.

EXAMPLES

Materials

Capsules were obtained from Lipo Technologies. Paraffin oil was used as the lubricant, and was encapsulated in either methoxy methyl methylol melamine (MMM) polymeric coating or polyoxymethylene urea (PMU). Three different average capsule sizes were used: 5 μm, 12 μm, and 14 μm.

Capsules on Transfer Roller

Figure 3:
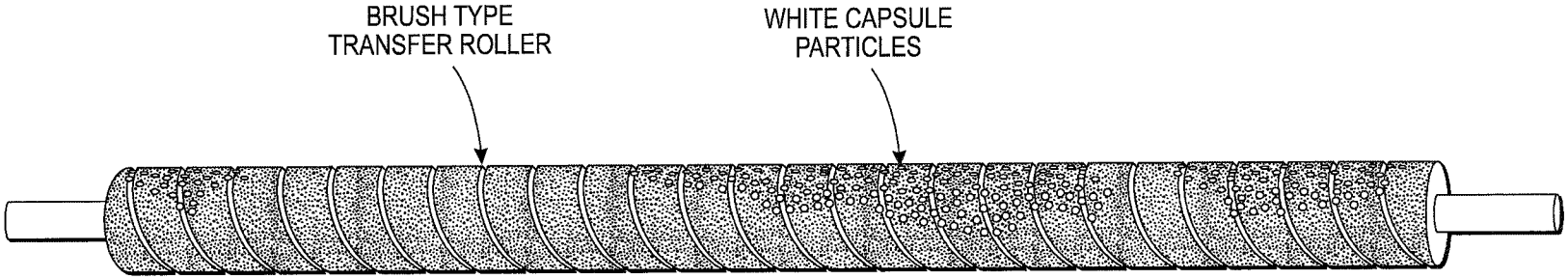
FIG. 3 illustrates a transfer member having paraffin oil-containing capsules on its surface.

A brush transfer roller was obtained. A container was used to hold lubricant-containing capsules. The transfer roller was placed in contact with the capsules and then rotated. The result is shown in FIG. 3. For later visualization purposes, an excess of capsules was used on the brush transfer roller. If desired, it is contemplated that a soft rubber blade can be used in the non-contact applicator to meter the quantity of capsules present on the transfer roller surface.

Applying Capsules to Imaging Member Surface

With the capsules on the transfer roller surface facing the imaging member surface, an electric field was generated by a high voltage power supply between the roller surface and the imaging member surface. The voltage was about 7 kV and the distance between the transfer roller surface and the imaging member surface was about 1 cm. Transfer of the capsules from the brush roller to the imaging member surface was visually verified.

Cleaning Blade Break Test

After the capsules were applied to the imaging member surface, the imaging member was rotated in an off-line test fixture which included a cleaning blade. The cleaning blade successfully broke the capsules, thereby coating the imaging member surface with paraffin oil.

Printing Test

Figure 4A:
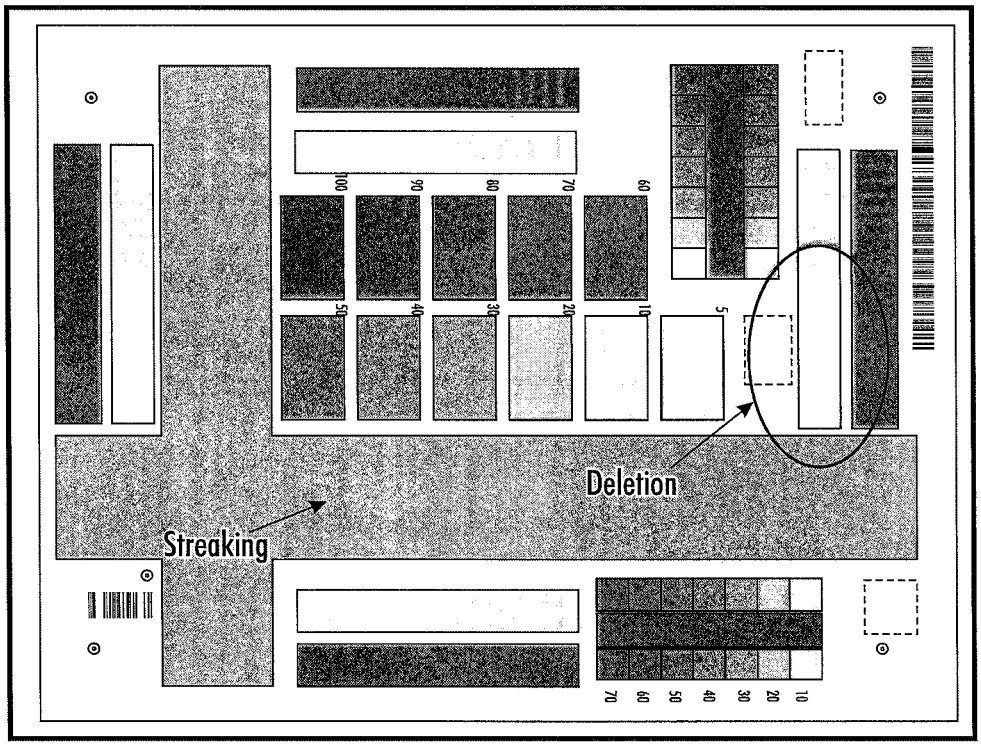
FIG. 4A illustrates a print test of the imaging member before lubricant was applied (greyscale).
Figure 4B:
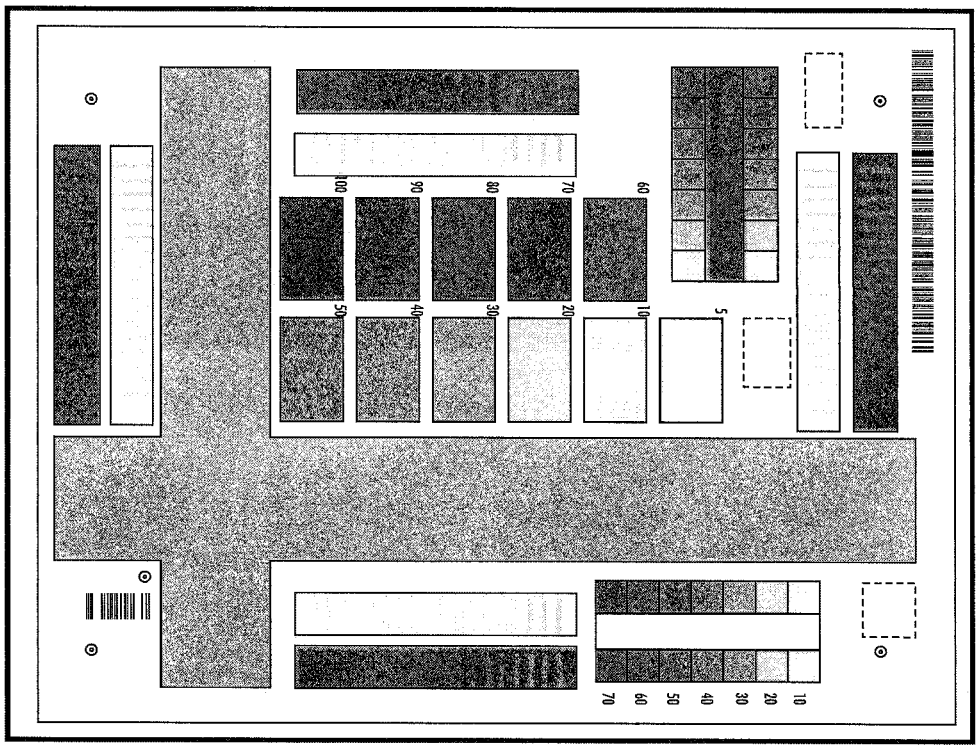
FIG. 4B illustrates a print test of the imaging member after lubricant was applied using non-contact means (grey-scale).

The imaging member was subsequently used in a print test. FIG. 4A illustrates the results of a print test of a control imaging member without applied capsules. FIG. 4B illustrates the results of a print test of an experimental imaging member which included applied capsules. Significant improvements were seen when lubricant was applied. In particular, the control imaging member (FIG. 4A) resulted in streaking and deletion which were not observed in the experimental imaging member (FIG. 4B).

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A method for lubricating an imaging member, comprising:

transferring capsules onto a surface of the imaging member via a non-contact applicator, the capsules having a core-shell structure, the shell comprising an encapsulant and the core comprising a lubricant; and breaking the capsules to release the lubricant and lubricate the surface of the imaging member.

2. The method of claim 1, wherein the imaging member is contained in a printing apparatus that further comprises a development member and a cleaning blade downstream of the development member; and wherein the capsules are added to the surface at a location downstream of the development member and upstream of the cleaning blade.

3. The method of claim 2, wherein the printing apparatus further comprises a transfer component downstream of the development member and upstream of the cleaning blade; and wherein the capsules are added to the surface at a location downstream of the transfer component and upstream of the cleaning blade.

4. The method of claim 1, wherein the lubricant comprises paraffin oil.

5. The method of claim 1, wherein the non-contact applicator comprises a capsule container that stores the lubricant-containing capsules, a transfer roller for transferring the lubricant-containing capsules electrostatically to the surface of the imaging member, and a metering member adjacent to the transfer roller for controlling the number of capsules that attach to a surface of the transfer roller.

6. The method of claim 5, further comprising:

generating an electrical field between the transfer roller and the surface of the imaging member.

7. The method of claim 5, wherein the transfer roller is a brush roller or a foam roller.

8. The method of claim 1, wherein the encapsulant is selected from the group consisting of methoxy methyl methylol melamine (MMM) and polyoxymethylene urea (PMU).

9. The method of claim 1, wherein the capsules have an average particle size of from about 3 micrometers (μm) to about 16 micrometers.

10. The method of claim 9, wherein the capsules have an average size of from about 5 μm to about 14 μm.

11. The method of claim 1, wherein a distance between the surface of the imaging member and a transfer roller of the non-contact applicator is from about 0.1 cm to about 10 cm.

12. A printing apparatus comprising:

an imaging member;

a development member for forming a developed image on the imaging member;

a cleaning blade downstream of the development member; and a non-contact applicator located downstream of the development member and upstream of the cleaning blade;

wherein the non-contact applicator comprises:

a capsule container for storing lubricant-containing capsules; and a transfer roller for removing the lubricant-containing capsules from the capsule container; and a power supply for generating an electric field between the transfer roller and a surface of the imaging member.

13. A method for increasing the lifetime of an imaging member of a printing apparatus, comprising:

monitoring the friction level between a surface of the imaging member and a second component of the printing apparatus; and when the friction level exceeds a predetermined threshold value, adding lubricant-containing capsules onto a surface of the imaging member via a non-contact applicator.

14. The method of claim 13, wherein the friction level is monitored by measuring changes in torque of the imaging member.

15. The method of claim 13, further comprising breaking the capsules on the surface of the imaging member against a cleaning blade to release the lubricant and lubricate the surface of the imaging member.

16. The method of claim 13, wherein the printing apparatus further comprises a transfer component and a cleaning blade downstream of the transfer component; and wherein the capsules are added to the surface at a location downstream of the transfer component and upstream of the cleaning blade.

17. The method of claim 13, wherein the non-contact applicator comprises a capsule container that stores the lubricant-containing capsules, a transfer roller for transferring the lubricant-containing capsules electrostatically to the surface of the imaging member, and a metering member adjacent to the transfer roller for controlling the number of capsules that attach to the surface of the transfer roller.

18. The method of claim 17, further comprising:

generating an electrical field between the transfer roller and the surface of the imaging member.

19. The apparatus of claim 12, wherein a distance between the surface of the imaging member and the transfer roller of the non-contact applicator is from about 1.0 cm to about 10 cm.

20. The apparatus of claim 12, further comprising (i) a driving motor for the imaging member or the development member, and (ii) a transmission gear system running from the driving motor to the transfer roller of the non-contact applicator.

* * * * *